US011795775B2

(12) United States Patent
Van Mook et al.

(10) Patent No.: US 11,795,775 B2
(45) Date of Patent: Oct. 24, 2023

(54) ELECTRICAL FEEDTHROUGH SYSTEM AND METHODS OF USE THEREOF

(71) Applicant: FMC Technologies, Inc., Houston, TX (US)

(72) Inventors: Erik Van Mook, Houston, TX (US); Matthew Keller, Houston, TX (US); Christopher Kennedy, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 203 days.

(21) Appl. No.: 17/432,385

(22) PCT Filed: Feb. 19, 2020

(86) PCT No.: PCT/US2020/018840
§ 371 (c)(1),
(2) Date: Aug. 19, 2021

(87) PCT Pub. No.: WO2020/172286
PCT Pub. Date: Aug. 27, 2020

(65) Prior Publication Data

US 2022/0154544 A1 May 19, 2022

Related U.S. Application Data

(60) Provisional application No. 62/808,111, filed on Feb. 20, 2019.

(51) Int. Cl.
*H01R 29/00* (2006.01)
*E21B 33/038* (2006.01)
(Continued)

(52) U.S. Cl.
CPC ..... *E21B 33/0385* (2013.01); *H01R 13/5202* (2013.01); *H01R 13/523* (2013.01); *H01R 13/7036* (2013.01); *H01R 43/005* (2013.01)

(58) Field of Classification Search
CPC ..... H01R 13/5202; H01R 13/523; H01R 13/7036; H01R 43/005; E21B 33/0385
(Continued)

(56) References Cited

U.S. PATENT DOCUMENTS 3,643,207 A * 2/1972 Cairns ..... H01R 13/523 439/272
4,142,770 A * 3/1979 Butler, Jr. ..... H01R 13/523 439/140

(Continued)

OTHER PUBLICATIONS

International Search Report issued in International Application No. PCT/US2020/018840 dated May 28, 2020 (3 pages).

(Continued)

*Primary Examiner* — Abdullah A Riyami
*Assistant Examiner* — Vladimir Imas
(74) *Attorney, Agent, or Firm* — Osha Bergman Watanabe & Burton LLP

(57) ABSTRACT

An electrical feedthrough assembly has a lower assembly having a first end and a second end. The lower assembly includes an outer body with a lower housing and an upper housing disposed within a bore of the outer body and a first conductor extending from the lower housing to the upper housing. Additionally, the lower housing extends axial outward from the outer body to form the first end and the upper housing extends axial outward from the outer body to form the second end. Further, the electrical feedthrough assembly has an upper assembly having body extending from a first end to a second end. The second body includes a pin end at the first end inserted into an opening of the second end of the lower assembly. A second conductor is disposed within the body. A piston is disposed within the body configured to move the second conductor.

20 Claims, 4 Drawing Sheets

(51) Int. Cl.
*H01R 13/52* (2006.01)
*H01R 13/523* (2006.01)
*H01R 13/703* (2006.01)
*H01R 43/00* (2006.01)

(58) Field of Classification Search
USPC ..... 439/188
See application file for complete search history.

(56) References Cited

U.S. PATENT DOCUMENTS 4,589,492 A * 5/1986 Greiner ..... E21B 33/0385 439/194
4,767,349 A * 8/1988 Pottier ..... E21B 17/028 439/271
5,899,765 A * 5/1999 Niekrasz ..... H01R 13/523 439/201
6,776,636 B1 * 8/2004 Cameron ..... H01R 13/523 439/191
6,932,636 B2 * 8/2005 Abbey ..... H01R 13/629 439/138
8,142,215 B2 * 3/2012 Hafskjold ..... H02G 15/26 439/201
8,816,196 B2 * 8/2014 Williams ..... H02G 15/04 174/23 R
9,306,340 B2 * 4/2016 Chen ..... H02G 15/103
9,391,392 B2 * 7/2016 Ranalli ..... G02B 6/3816
10,916,881 B2 * 2/2021 Vassgård ..... H01R 13/6272
11,572,743 B2 * 2/2023 Leismer ..... H01R 13/5219
2002/0050361 A1 * 5/2002 Shaw ..... E21B 43/128 166/380
2004/0266240 A1 12/2004 Abbey et al.
2005/0042903 A1 2/2005 Nicholson
2016/0276775 A1 9/2016 Nicholson
2019/0044256 A1 2/2019 Gelderd et al.
2022/0302636 A1 * 9/2022 Burrow ..... H01R 13/62961

OTHER PUBLICATIONS

Written Opinion issued in International Application No. PCT/US2020/018840 dated May 28, 2020 (7 pages).

* cited by examiner

ELECTRICAL FEEDTHROUGH SYSTEM AND METHODS OF USE THEREOF

FIELD OF THE DISCLOSURE

Embodiments disclosed herein relate generally to subsea oil and gas operations equipment. More specifically, embodiments disclosed herein relate to systems and methods of use for an electrical feedthrough to provide power to subsea equipment.

BACKGROUND

In oil and gas, subsea operations may be performed in waters offshore at great depths. In order to recover hydrocarbons from a well, any number of electrical systems may be deployed on the seabed to perform subsea operations. Many of these electrical systems need high-reliability power grids and power control units located on the seabed, offshore rig, and/or buoyant devices to power various devices. Power systems play a major role in providing the required and reliable power to the various electrical systems. But, there are many challenges for deploying power components under the seabed such as the requirements of power system components operating in subsea environment, use of electronics for efficient transmission of power from the offshore platform or from the shore to the subsea electrical loads, variable speed drive systems, and research areas related to power electronics for subsea electrical systems.

In conventional methods, power is provided from external sources to the subsea devices via cable conductors to submerged process control equipment, pumps and compressors, transformers, motors, and other electrically operated equipment. As these components are disposed subsea and are typically enclosed and protected by water-proof pressure vessels, power is provided by means of a cable termination and connector, which may be an electrical penetrator, designed to penetrate and provide power through a subsea tree.

As described above, the installation and operation of subsea electrical systems have various challenges. Pressure increases about 10 bar (about 145 PSI) for every 100 m depth in the ocean, and thus, for electrical systems needing to be located at a water depth of about 3000 m, the electrical systems encounters about 300 bar pressure. At these depths, all the electrical components have to be designed and qualified to withstand high pressures. Additionally, sea water is a conductor and corrosive, hence proper isolation between the electrical equipment and the sea water needs to be provided. As the equipment is located at depths of up to 3,000 m, in the event of fault, maintenance will be a challenge and will not be possible without bringing the equipment to the surface. However, bringing the equipment to surface is expensive and can result in long production outages. In some instances, the reliability of the equipment for the subsea applications has to be designed for more than 20 years.

Typically, electrical power for the subsea operations is generated in two different ways, one being offshore power generation and the other is onshore generating station. In the case of offshore power generation, gas turbine driven generators may be installed on the platforms. In the case of onshore generating stations, subsea devices such as electric submergible pumps ("ESP") and compressors are located very far from the onshore generating stations, it requires a long tieback power transmission system. Further, using high power high voltage AC transmission systems may minimize the power losses, and the reactive power due to the large capacitance of the power umbilical. In addition, the long distance high power and high voltage transmission/distribution require strong power cables with good insulation capability. The power umbilical can be fully electric or multiplexed wherein both electrical and hydraulic lines are combined to feed power from the power generator to the subsea device.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to an electrical feedthrough assembly may have a lower assembly having a first end and a second end. The lower assembly may include an outer body with a lower housing and an upper housing disposed within a bore of the outer body and a first conductor extending from the lower housing to the upper housing, wherein at least one portion of the first conductor is enclosed in a first insulator. In addition, the lower housing extends axial outward from the outer body to form the first end and the upper housing extends axial outward from the outer body to form the second end. Further, the electrical feedthrough assembly may have an upper assembly having body extending from a first end to a second end. The second body may include a pin end at the first end inserted into an opening of the second end of the lower assembly; a second conductor disposed within the body and at least one portion of the second conductor is enclosed in a second insulator; a piston disposed within the body configured to move the second conductor, and a dielectric fluid provided within at least one chamber of the piston. Furthermore, the second conductor is conductively connected to the first conductor and a length of the first conductor is in contact with an electrical contact of the upper assembly.

In one aspect, the embodiments disclosed herein relate to a method of connecting a first end of a lower assembly of an electrical feedthrough assembly to a subsea device; inserting a pin end at a first end of an upper assembly of the electrical feedthrough assembly into a second end of the lower assembly; passing a first conductor of the lower assembly through the pin end and into the upper assembly; actuating a piston in the upper assembly to move a second conductor of the upper assembly such that a first end of the second conductor moves from a first electrical contact in the upper assembly to a second electrical contact in the upper assembly and second end of the second conductor moves to a third electrical contact; contacting the first conductor of the lower assembly to the first electrical contact; connecting a second end of a upper assembly to a subsea tree; contacting the third conductor of a power source to a third electrical contact in the upper assembly; and powering subsea devices conductively through the electrical feedthrough assembly.

Other aspects and advantages will be apparent from the following description and the appended claims.

DETAILED DESCRIPTION

Figure 1:
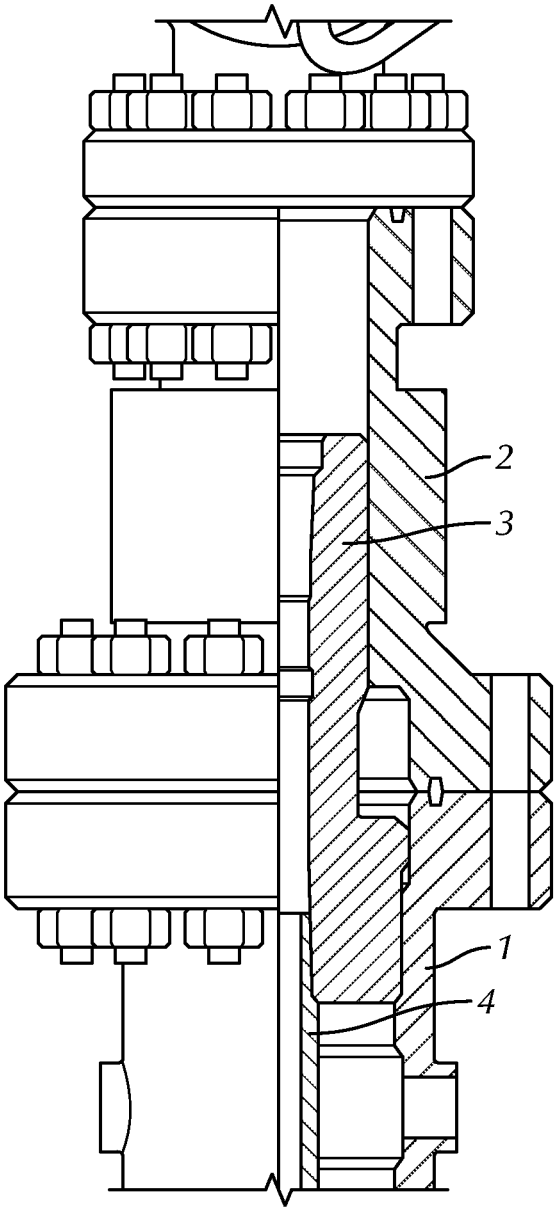
FIG. 1 (Prior Art)
FIG. 1 is a perspective view of a wellhead in accordance with one or more embodiments of the prior art.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" "attached" or "attached to" may indicate establishing either a direct or indirect connection, and is not limited to either unless expressly referenced as such. In addition, as used herein, the terms "upper" and "lower" are merely used to indicate relative position and may change depending on orientation, and are not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification. In addition, any terms designating tree or tubing head (i.e., any wellheads or tubing hanger) at a rig type (i.e., any land rig or offshore rig) should not be deemed to limit the scope of the disclosure. As used herein, fluids may refer to slurries, liquids, gases, and/or mixtures thereof. It is to be further understood that the various embodiments described herein may be used in various stages of a well, such as rig site preparation, drilling, completion, abandonment etc., and in other environments, such as work-over rigs, fracking installation, well-testing installation, oil and gas production installation, without departing from the scope of the present disclosure. It is recognized by the different embodiments described herein that a tree or tubing head plays a valuable and useful role in the life of a well. Further, it is recognized that electrical feedthrough assembly configuration and arrangement of components for providing electrical power to subsea devices according to one or more embodiments described herein may provide a cost effective alternative to conventional systems. The embodiments are described merely as examples of useful applications, which are not limited to any specific details of the embodiments herein.

In one aspect, embodiments disclosed herein relate to an electrical feedthrough assembly, such as electrical conductor that may be used to provide power to subsea devices, for example. The electrical feedthrough assembly may also be interchangeably referred to as an electrical penetrator assembly in the present disclosure. According to embodiments of the present disclosure, the electrical feedthrough assembly is an apparatus that may include a lower assembly and an upper assembly coupled together. In a non-limiting example, a pin end of the upper assembly is inserted into an opening of the lower assembly to conductively connect a conductor of the lower assembly to a conductor of the upper assembly. One skilled in the art will appreciate that by conductively connecting the conductor of the lower assembly to the conductor of the upper assembly, power is able to be provided through the electrical feedthrough assembly.

Referring to FIG. 1, FIG. 1 illustrates wellhead 1 in accordance with one or more embodiments of the prior art. Wellheads are well known in the art, and thus, a brief overview is given to help provide a general view of the embodiments disclosed herein. The wellhead 1 includes a tubing head 2 disposed on the wellhead 1. Additionally, the tubing head 1 contains a tubing hanger assembly 3 for engaging down hole equipment (not shown). Furthermore, the wellhead and the tubing head 2 may include a port 4 to perform various wellbore and annulus operations. One with ordinary skill in the art would understand that FIG. 1 illustrates one example of a wellhead; however, the wellhead 1 may take any form (i.e., number of components, shape, or size) known in the art without departing from the scope of the present disclosure.

Figure 2:
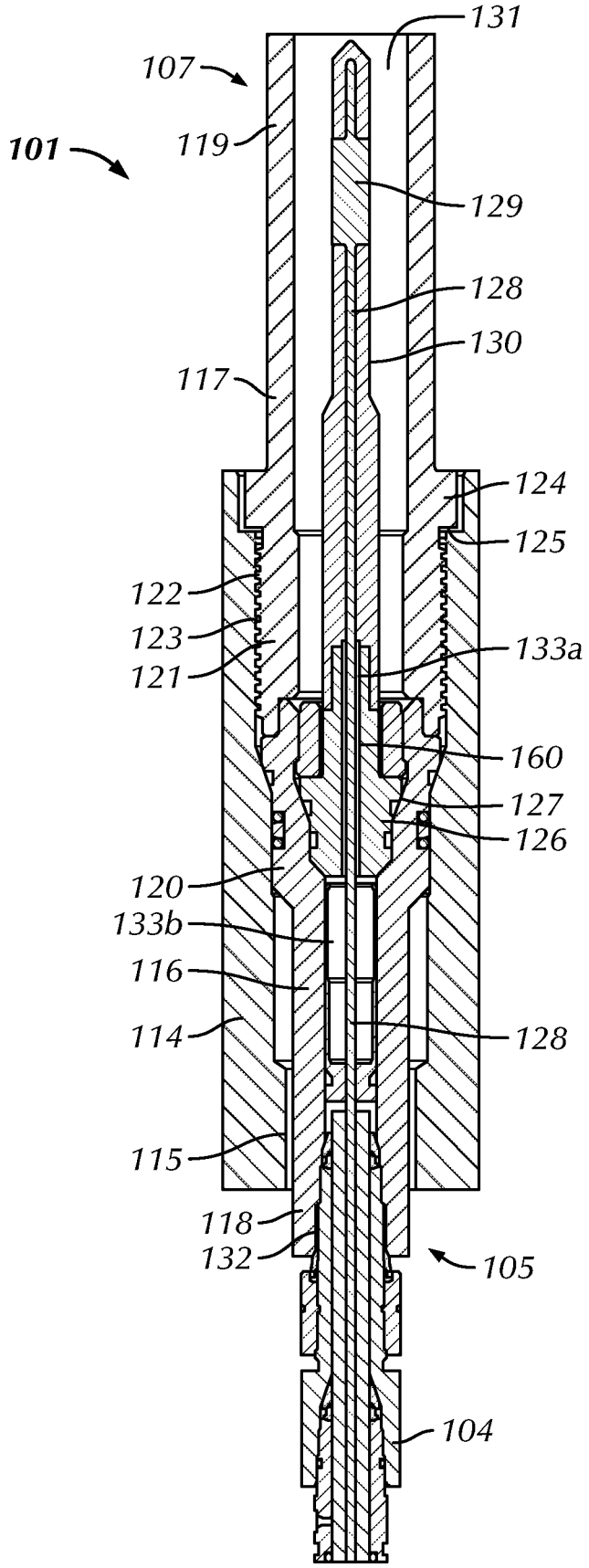
FIG. 2 is a cross-sectional view of a lower assembly of an electrical feedthrough assembly in accordance with one or more embodiments of the present disclosure.

Now referring to FIG. 2, in one or more embodiments, FIG. 2 illustrates a cross-sectional view of the lower assembly 101 of an electrical feedthrough assembly (See FIG. 4) in accordance with the present disclosure. The lower assembly 101 may include an outer body 114 with a bore 115, such as a metal sub. In some embodiments, a lower housing 116 and an upper housing 117 may be disposed in the bore 115. The lower housing 116 and the upper housing 117 may be made from metal. It is further envisioned that a lower end 118 of the lower housing 116 and an upper end 119 of the upper housing 117 may extend outside the bore 115 to form a first end 105 and a second end 107 of the lower assembly 101, respectively. Furthermore, a first full-metal-jacket ("FMJ") connector 104 may be inserted into an opening 132 at a first end 105 of the lower housing 116. In a non-limiting example, the first FMJ connector 104 may be a dual redundant metal-to-metal seal with multiple fittings such as the FMJ connector by Halliburton. In some embodiments, an opening 131 of the upper housing 117 may be exposed to a surrounding environment. In addition, an upper end 120 of the lower housing 116 may be coupled to a lower end 121 of the upper housing 117. Further, the lower end 121 of the upper housing 117 may be threaded onto an outer surface 122 to connect to threads 123 in the bore 115. It is further envisioned that the upper housing 117 may have protrusions 124 extending outwardly to land on an inner load shoulder 125 of the outer body 114.

Still referring to FIG. 2, in one or more embodiments, an electrical penetrator 126 may be disposed at the upper end 120 of the lower housing 116. In a non-limiting example, the electrical penetrator 126 may include optics or ceramic to enable electrical transmission. Additionally, a metal-to-metal seal 127 may be inserted between the electrical penetrator 126 and the lower housing 116. As further shown in FIG. 2, the conductor 128 may extend a length of the lower assembly 101 to extend past the first end 105 into the tubing hanger assembly and connect to subsea devices. In a non-limiting example, the conductor 128 may be a wire or a shaft made of a material consisting of copper, gold, silver, aluminum, nickel-cobalt or any combinations thereof. It is further envisioned that the conductor 128 may have the conductor connector 129 attached thereof in the upper housing 117. One skilled in the art will appreciate how the conductor 128 may have an insulator 130, such as a polyether ether ketone ("PEEK") molding, surrounding a length of the conductor 128 to environmentally isolate the conductor 128. Further, glass bodies (133*a*, 133*b*) may be disposed around portions of the conductor 128 and a glass-to-metal seals 160 may be inserted between the glass bodies (133*a*, 133*b*) and metal housings (e.g., the electrical penetrator 126). While it is noted that FIG. 2 shows two glass bodies (133*a*, 133*b*), one of skill in the art would understand that this is merely a non-limiting example and any number of glass bodies may be used without departing from the present scope of the disclosure.

Figure 3:
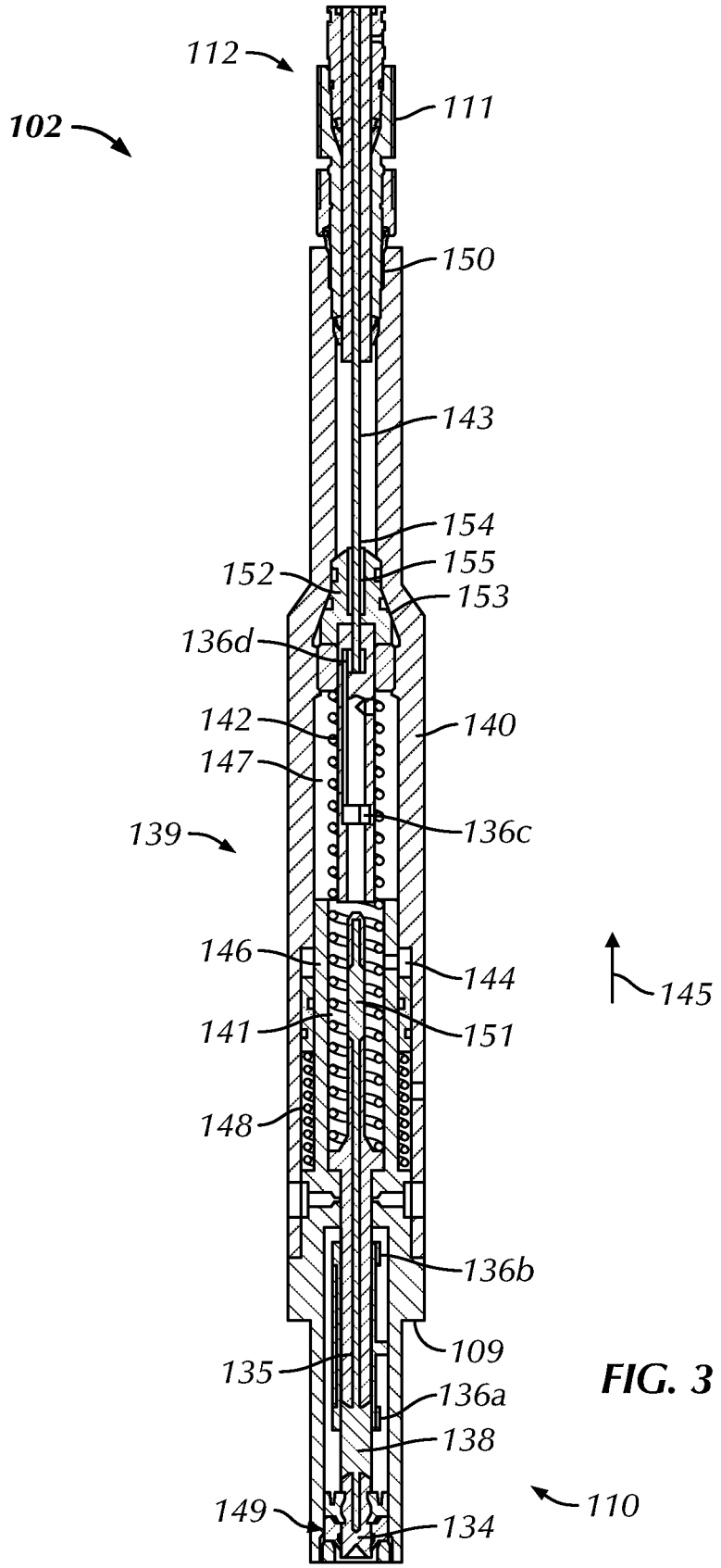
FIG. 3 is a cross-sectional view of an upper assembly of an electrical feedthrough assembly in accordance with one or more embodiments of the present disclosure.

Now referring to FIG. 3, in one or more embodiments, FIG. 3 illustrates a cross-sectional view of the upper assembly 102 of the electrical feedthrough assembly (See FIG. 4) in accordance with the present disclosure. The upper assembly 101 may be a body 139 extending from a first end 110 to a second end 112. It is further envisioned that the body 139 may have a middle portion 140 which has an outer diameter larger than an outer diameter of the first end 110 and the second end 112. Furthermore, a second full-metal-jacket ("FMJ") connector 111 may be inserted into an opening 150 of the upper assembly 102 at the second end 112 to be connected to a subsea tree connector of a subsea tree. The second FMJ connector 111 may be the same as the first FMJ connector 104. Additionally, within the middle portion 140, a piston 144 may be provided, such as pressure compensation piston. In a non-limiting example, the piston 144 may actuate (i.e., compress) as a conductor 135 moves in an upward direction (see block arrow 145) to have a conductor connector 138 of the conductor 135 of the upper assembly 102 engage a second electrical contact 136*b*. Additionally, an end conductor connector 141 of the conductor 135 of the upper assembly 102 moves in the upward direction (see the block arrow 145) to contact a third electrical contact 136*c*. Further, the piston 144 actuates when a pin end 134 of the upper assembly 102 is inserted into the opening (see FIG. 2) of the lower assembly (see FIG. 2) such that the conductor (see FIG. 2) of the lower assembly extends past the pin end 134. In addition, the pin end 134 may be fitted with elastomer wiper seals 149 to ensure the pin end 134 is sealed within the lower assembly. Furthermore, chambers (146, 147) around the piston 144 may be filled and sealed with a dielectric fluid (or gas) to fluidly isolate the conductor 135 and keep the piston 144 lubricated. In a non-limiting example, the dielectric fluid may selected from the group of transformer oils, perfluoroalkanes, and purified waters. It is further envisioned that a side 148 of the middle portion 140 may be exposed to a surrounding environment.

Still referring to FIG. 3, in one or more embodiments, an electrical penetrator 152 may be disposed at an area where the middle portion 140 meets the second end 112. In a non-limiting example, the electrical penetrator 152 may include optics or ceramic to enable electrical transmission. Additionally, a metal-to-metal seal 153 may be inserted between the electrical penetrator 152 and the body 139. As further shown in FIG. 4, the conductor 135 may extend a length of the upper assembly 102 to extend from the first end 110 into the middle portion 140. Further, the upper conductor 143 extends from the area where the middle portion 140 meets the second end 112 to be attached to a power source from a subsea tree. In a non-limiting example, the conductors (135, 143) may be a wire or a shaft made of a material consisting of copper, gold, silver, aluminum, nickel-cobalt or any combinations thereof. It is further envisioned that the conductor 135 may have the conductor connector 138 attached thereof in the first end 110. One skilled in the art will appreciate how the conductors (135, 143) may have an insulator 151, such as a polyether ether ketone ("PEEK") molding, surrounding a length of the conductors (135, 143) to environmentally isolate the conductor (135, 143). Further, glass bodies 154 may be disposed around portions of the conductors (135, 143) and a glass-to-metal seals 155 may be inserted between the glass bodies 154 and metal housings (e.g., the electrical penetrator 152).

Figure 4:
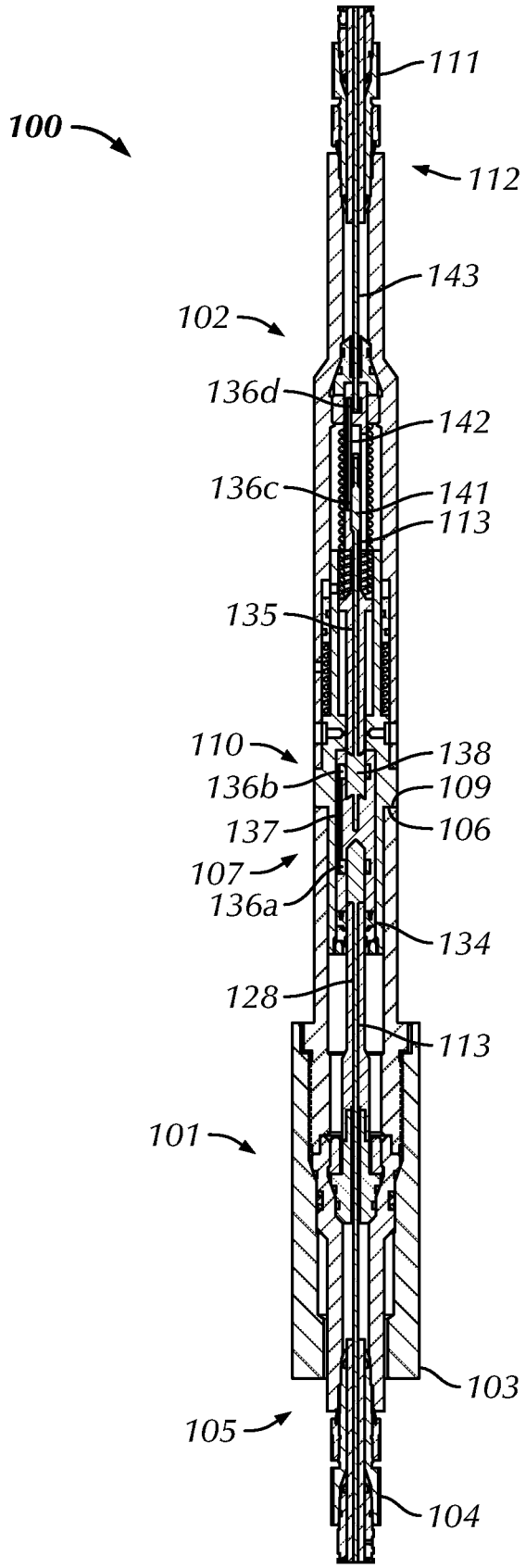
FIG. 4 is a cross-sectional view of an electrical feedthrough assembly in accordance with one or more embodiments of the present disclosure.

Now referring to FIG. 4, in one or more embodiments, an electrical feedthrough assembly 100 in accordance with the present disclosure is illustrated. The electrical feedthrough assembly 100 may include the lower assembly 101 and the upper assembly 102, as described in FIGS. 2 and 3. The lower assembly 101 may be connected to the tubing hanger assembly by landing a first shoulder 103 of the lower assembly 101 on a shoulder of the tubing hanger assembly. It is further envisioned that the first FMJ connector 104 may be used to couple the first end 105 of the lower assembly 101 to a tubing hanger connector of the tubing hanger assembly. In some embodiments, the second FMJ connector 111 may be used to couple the second end 112 of the upper assembly 102 to a subsea tree connector of a subsea tree.

In one or more embodiments, the upper assembly 102 may be coupled to the lower assembly 101 such that a second shoulder 106 at the second end 107 of the lower assembly 101 abuts and is flush against a first shoulder 109 at the first end 110 of the upper assembly 102. In a non-limiting example, a pin end 134 (e.g., a shuttle pin) of the upper assembly 102 is inserted into an opening (see FIG. 2) of the lower assembly 101 such that a conductor 128 of the lower assembly 101 is conductively connected to a conductor 135 of the upper assembly 102. It is further envisioned that the upper assembly 102 may include a plurality of electrical contacts (136*a*, 136*b*, 136*c*, 136*d*). While it is noted that FIG. 4 shows four electrical contacts (136*a*, 136*b*, 136*c*, 136*d*), one of skill in the art would understand that this is merely a non-limiting example and any number of electrical contacts may be used without departing from the present scope of the disclosure. In a non-limiting example, once the upper assembly 102 is coupled to the lower assembly 101, a piston (see FIG. 3) of the upper assembly 102 is actuated such that a first electrical contact 136*a* of the upper assembly 102 may contact a conductor connector 129 of the conductor 128 of the lower assembly 101. Further, the conductor connector 129 of the conductor 128 of the lower assembly 101 extends past the pin end 134 to be inserted into the upper assembly 102. One skilled in the art will appreciate how the piston may be automatically actuated from the pressure of coupling the upper assembly 102 to the lower assembly 101. In addition, a wire 137 connects the first electrical contact 136*a* to a second electrical contact 136*b* in contact with a conductor connector 138 of the conductor 135 of the upper assembly 102. One skilled in the art will appreciate that by coupling the lower assembly 101 to the upper assembly 102 and having the electrical contacts (136*a*, 136*b*) conductively connecting each of the conductors (128, 135), a continuous conductor 113 is formed within the electrical feedthrough assembly 100. With the continuous conductor 113 being formed, power may be provided through the electrical feedthrough assembly 100. It is further envisioned that when the upper assembly 102 is coupled to the lower assembly 101, the piston (see FIG. 4) of the upper assembly 102 is actuated such an end conductor connector 141 of the conductor 135 of the upper assembly 102 contacts a third electrical contact 136*c* with a second wire 142 connecting from the third electrical contact 136*c* to a fourth electrical contact 136*d*. Further, the fourth electrical contact 136*d* contacts an upper conductor 143 extending out from the upper assembly 102 to be attached to a power source.

Electrical feedthrough assemblies, according to embodiments herein, are apparatuses that include multiple conductors within a lower assembly and upper assembly, which may include a piston with one dialectical fluid in upper assembly to compensate for motion and thermal expansion, and may include no environment compressible bladders installed within the multiple components that are arranged in a certain layout and contained within the electrical feedthrough assembly. The elimination of environment compressible bladders and the need for multiple fluids in the electrical feedthrough assembly significantly improves the operational safety, reliability, and longevity during drilling, completions, production, and work-over operations, while providing continuous power through the electrical feedthrough assembly. Further, a pin end of the upper assembly is inserted into an opening of the lower assembly to conductively connect a conductor of the lower assembly to a conductor of the upper assembly. In addition, one or more glass-to-metal seals and metal-to-metal seals, along with PEEK molding, may be used to environmentally isolate the conductors of the electrical feedthrough assembly. Furthermore, other instruments and devices, including without limitation, sensors and various valves may be incorporated within the electrical feedthrough assembly.

Conventional electrical feedthrough devices for subsea power distribution in the oil and gas industry are typically isolated conductors with various fluid profiles within each bladder of said conventional electrical feedthrough devices. Conventional methods may include an extensive layout and arrangement to ensure the conductors may be properly isolated and effective within said conventional electrical feedthrough devices. In some instances, conventional electrical feedthrough devices are manufactured to include multiple slots and chambers used to hold the bladders with various fluid profiles and an apparatus to the various fluid profiles do not mix. Such conventional electrical feedthrough devices may be more expensive to manufacture because of the extra machining needed to account for the various fluid profiles. Further, the use of bladders with various fluid profiles may increase the potential for gas and cycling build-up within the conventional electrical feedthrough devices as well as of leak paths to the environment. Additionally, conventional methods merely use elastomer seals which may cause the conventional electrical feedthrough devices to consistently fail an ohms test. This additional need for bladders with various fluid profiles and elastomer seals, increases the number of leak paths, adds to manufacturing and installation costs, and decreases the operational safety.

The electrical feedthrough assembly is often used for assisting in providing power and electricity to well devices. Examples of the electrical feedthrough assembly may be used for drilling, completion applications, including natural flow, gas lift, and artificial lift systems in onshore and offshore wells and to continue producing for conventional and unconventional wells. Examples of electrical feedthrough assembly, according to embodiments herein, may include a two-piece assembly for nominal wellhead sizes range from 7 1/16 inches to 11 inches and above, and with any power range required for various well operations. Achieving a successful conductor connection of the electrical feedthrough assembly in the tubing hanger is an important part of a well operation. Additional challenges further exist in a subsea environment for safely conductively connecting the electrical feedthrough assembly to the tubing hanger while both minimizing costs and providing reliability for future changes to the overall layout of a field or well.

Accordingly, one or more embodiments in the present disclosure may be used to overcome such challenges as well as provide additional advantages over conventional methods of retention, as will be apparent to one of ordinary skill. In one or more embodiments, an electrical feedthrough assembly may be safer, faster, and lower in cost as compared with conventional methods due, in part, to multiple electrical contacts within the electrical feedthrough assembly conductively connecting conductors from a lower and upper assembly of the electrical feedthrough assembly. Additionally, the electrical feedthrough assembly may comprise a piston (with one dielectric fluid) and pin end within the upper assembly to aid in conductively connecting the conductor from the lower assembly to the conductor of the upper assembly to form a continuous conductor that require no need for bladders with various fluid profiles, and thus, relaxing control tolerances and improving manufacture (i.e. reduced cost and reduced time to manufacture). Overall the electrical feedthrough assembly may minimize product engineering, risk associated with electrical feedthrough assembly, reduction of assembly time, hardware cost reduction, and weight and envelope reduction. Additionally, one skilled in the art will appreciate how the electrical feedthrough assembly, according to embodiments herein, may be attached to any subsea devices without the departing from the scope of the present disclosure.

Furthermore, methods of the present disclosure may include use of the electrical feedthrough assembly 100 and other structures, such as in FIGS. 2-4 for providing power to subsea devices. Because the method may apply to any of the embodiments, reference numbers are not referenced to avoid confusion of the numbering between the different embodiments.

Initially, a lower assembly of an electrical feedthrough assembly is coupled to a tubing hanger. In a non-limiting example, a first FMJ connector inserted into an opening of a lower housing of the lower assembly is connected to a tubing hanger connector such that a conductor of the lower assembly extends into the tubing hanger. Additionally, an electrical penetrator may be used to aid in continuing the conductor into the lower assembly. Next, an upper assembly of the electrical feedthrough assembly is landed on the lower assembly. In a non-limiting example, a pin end at a first end of the upper assembly is inserted into an opening of an upper housing of the lower assembly opposite the end of the FMJ connector. Further, a shoulder of the upper assembly abuts and is flush onto a shoulder of lower assembly. By inserting the pin end, a conductor connector of the conductor of the lower assembly extend into the upper assembly though the pin end to contact a first electrical contact. In addition, a second FMJ connector inserted into an opening at the second end of lower assembly is connected to a subsea tree.

In some embodiments, a piston is provided with the upper assembly is actuated to move a first connector conductor of the conductor of the upper assembly from the first electrical contact to a second electrical contact. The first electrical contact and the second electrical contact are connected via a wire. Additionally, the piston moves a second connector conductor of the conductor of the upper assembly to a third electrical contact, which is connected to a fourth electrical contact via wire. Further, a dialectic fluid is provided within chambers of the piston to isolated and insulates the conductors as well as lubricating the piston. At a second end of the upper assembly, an upper conductor connected to a power/electrical source extends into the upper assembly to contact the fourth electrical contact such that power/electricity may be provided to the electrical feedthrough assembly. Furthermore, lengths of the conductors in the lower and upper assemblies may be insulated with PEEK molding. Additionally, glass bodies may be provided on the conductors in the lower and upper assemblies. It is further envisioned that glass-to-metal seals may be provided to seal the glass bodies from metal parts. In addition, metal-to-metal seal may be provided to seal any meat parts within the electrical feedthrough assembly. With the electrical feedthrough assembly attached from the tubing hanger to subsea tree, power/electricity may travel from a source (at the seabed, platform, or onshore), via cables or wires, to the conductors of the electrical feedthrough assembly such that power/electricity may be provided to subsea devices.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. An electrical feedthrough assembly, comprising:

a lower assembly having a first end and a second end, wherein the lower assembly comprises:

an outer body with a lower housing and an upper housing disposed within a bore of the outer body, wherein the lower housing extends axial outward from the outer body to form the first end, wherein the upper housing extends axial outward from the outer body to form the second end, a first conductor extending from the lower housing to the upper housing, wherein at least one portion of the first conductor is not enclosed in a first insulator; and an upper assembly having body extending from a first end to a second end, wherein the upper assembly comprises:

a pin end at the first end, wherein the pin end is inserted into an opening of the second end of the lower assembly, a second conductor disposed within the body, wherein at least one portion of the second conductor is not enclosed in a second insulator, a piston disposed within the body, wherein the piston is configured to move the second conductor, and a dielectric fluid provided within at least one chamber of the piston, wherein the second conductor is conductively connected to the first conductor upon being moved by the piston in an upward direction when the upper assembly is coupled to the lower assembly, wherein a length of the first conductor is in contact with an electrical contact of the upper assembly.

2. The electrical feedthrough assembly of claim 1, wherein a shoulder at the first end of the upper assembly abuts a shoulder at the second end of the lower assembly.

3. The electrical feedthrough assembly of claim 1, wherein the first insulator and the second insulator are formed from a polyether ether ketone molding.

4. The electrical feedthrough assembly of claim 1, wherein a side of the upper assembly adjacent to the piston is exposed to a surrounding environment.

5. The electrical feedthrough assembly of claim 1, wherein the pin end is a shuttle pin for the length of the first conductor to travel through.

6. The electrical feedthrough assembly of claim 1, wherein protrusions of the upper housing abut a load shoulder of the outer body, and wherein threads of the upper housing are threaded to threads of the outer body.

7. The electrical feedthrough assembly of claim 6, wherein the lower housing is coupled to the upper housing.

8. The electrical feedthrough assembly of claim 1, wherein the upper assembly comprises a plurality of electrical contacts.

9. The electrical feedthrough assembly of claim 8, wherein the length of the first conductor is in contact with a first electrical contact of the plurality of electrical contacts.

10. The electrical feedthrough assembly of claim 9, wherein the second conductor is in contact with a second electrical contact and a third electrical contact of the plurality of electrical contacts.

11. The electrical feedthrough assembly of claim 1, wherein the plurality of electrical contacts are connected together by wires and the second conductor.

12. The electrical feedthrough assembly of claim 1, further comprising at least one electrical penetrator in the lower assembly and the upper assembly.

13. The electrical feedthrough assembly of claim 1, further comprising at least one glass-to-metal seal and at least one metal-to-metal seal with each of the lower assembly and upper assembly.

14. A method, comprising:

connecting a first end of a lower assembly of an electrical feedthrough assembly to a subsea device;

inserting a pin end at a first end of an upper assembly of the electrical feedthrough assembly into a second end of the lower assembly;

passing a first conductor of the lower assembly through the pin end and into the upper assembly such that a piston is actuated in the upper assembly to move a second conductor of the upper assembly such that a first end of the second conductor moves from a first electrical contact in the upper assembly to a second electrical contact in the upper assembly and second end of the second conductor moves to a third electrical contact;

contacting the first conductor of the lower assembly to the first electrical contact, wherein a first wire connects the first electrical contact to the second electrical contact;

connecting a second end of an upper assembly to a subsea tree;

contacting a third conductor of a power source to a fourth electrical contact in the upper assembly, wherein a second wire connects the third electrical contact to the fourth electrical contact; and powering subsea devices conductively through the electrical feedthrough assembly.

15. The method of claim 14, further comprising insulating a length of the first and second conductor with a polyether ether ketone molding.

16. The method of claim 15 further comprising providing a glass-to-metal seal on at least one portion the first conductor and the second conductor with the polyether ether ketone molding.

17. The method of claim 16, further comprising providing a metal-to-metal seal within the electrical feedthrough assembly.

18. The method of claim 14, further comprising isolating the second conductor and lubricating the piston with a dielectric fluid.

19. The method of claim 14, further comprising exposing a side of the upper assembly adjacent to the piston to a surrounding environment.

20. The method of claim 14, further comprising sealing the pin end with an elastomer seal.

* * * * *